US006692585B2

(12) United States Patent
Uehara et al.

(10) Patent No.: US 6,692,585 B2
(45) Date of Patent: Feb. 17, 2004

(54) FERRITIC FE-CR-NI-AL ALLOY HAVING EXELLENT OXIDATION RESISTANCE AND HIGH STRENGTH AND A PLATE MADE OF THE ALLOY

(75) Inventors: Toshihiro Uehara, Yonago (JP); Yoshihiro Minagi, Yasugi (JP); Kenichi Inoue, Yasugi (JP)

(73) Assignee: Hitachi Metals Ltd., Tokyo (JP)

( * ) Notice: Subject to any disclaimer, the term of this patent is extended or adjusted under 35 U.S.C. 154(b) by 0 days.

(21) Appl. No.: 10/000,079

(22) Filed: Dec. 4, 2001

(65) Prior Publication Data

US 2002/0124913 A1 Sep. 12, 2002

(30) Foreign Application Priority Data

Dec. 4, 2000 (JP) ..... 2000-368686

(51) Int. Cl.[7] ..... C22C 38/50; C22C 38/06
(52) U.S. Cl. ..... 148/326; 148/325
(58) Field of Search ..... 148/328, 323–327; 420/43, 44, 45, 46, 47, 48, 49, 50

(56) References Cited

U.S. PATENT DOCUMENTS 4,790,977 A * 12/1988 Daniels et al. ..... 420/104
5,851,316 A * 12/1998 Yazawa et al. ..... 148/325
6,296,953 B1 * 10/2001 Linden et al. ..... 428/681

FOREIGN PATENT DOCUMENTS

| | | | |
|---|---|---|---|
| JP | 3-236449 | 10/1991 | ..... C22C/38/00 |
| JP | 8-30254 | 3/1996 | ..... C22C/38/00 |
| JP | 9-263906 | 10/1997 | ..... C22C/38/00 |
| JP | 3099911 | 8/2000 | ..... C22C/38/00 |

* cited by examiner

*Primary Examiner*—Deborah Yee
(74) *Attorney, Agent, or Firm*—Sughrue Mion, PLLC

(57) ABSTRACT

Disclosed is a ferritic Fe—Cr—Ni—Al alloy having excellent oxidation resistance and high strength, which consists essentially of, by mass, 0.003 to 0.08% C, 0.03 to 2.0% Si, not more than 2.0% Mn, from more than 1.0% to not more than 8.0% Ni, from not less than 10.0% to less than 19.0% Cr, 1.5 to 8.0% Al, 0.05 to 1.0% Zr, and the balance of Fe and incidental impurities, wherein an F value is not less than 12% and an S value is not more than 25%, where the F value is defined by the following equation (1) and the S value is defined by the following equation (2): (1) $F=-34.3C+0.48Si-0.012Mn-1.4Ni+Cr+2.48Al$, and (2) $S=Ni+Cr+Al$. The Fe—Cr—Ni—Al alloy, after an annealing heat treatment at 600 to 1050° C., has 0.2% yield strength of 550 to 1,000 MPa by a tensile test at room temperature.

40 Claims, No Drawings

FERRITIC FE-CR-NI-AL ALLOY HAVING EXELLENT OXIDATION RESISTANCE AND HIGH STRENGTH AND A PLATE MADE OF THE ALLOY

BACKGROUND OF THE INVENTION

1. Field of the Invention

The present invention relates to a ferritic Fe—Ni—Cr—Al alloy having both of excellent oxidation resistance and high-strength, which is suitable for use mainly in the atmospheric environment around room temperature after formation of an oxide film on the surface of the alloy under exposure to a high-temperature oxidation atmosphere, and a plate made of the alloy.

2. Description of the Related Art

Conventionally, the electrothermic alloys of Fe—Cr and Ni—Cr as defined in JIS C2520 have been well known as those having excellent oxidation resistance used in the atmospheric environment at a temperature range of from room temperature to a high temperature. Those alloys are excellent in oxidation resistance, and widely used for high-temperature heating elements.

On the other hand, JP-A-9-263906 discloses a ferritic Fe—Ni—Cr—Al alloy and a method for manufacturing the same, the ferritic Fe—Ni—Cr—Al alloy having excellent properties of corrosion resistance to molten metal and wear resistance.

While, with regard to the electrothermic Fe—Cr alloys and Ni—Cr alloys defined in JIS C2520, the electric resistance thereof is an important factor because of those use, taking their use, around room temperature, into consideration, any particular attentions have not been paid to the strength thereof. Therefore, when the alloys are used for structural members or parts for which oxidation resistance and strength at room temperature are required, the members or parts can not help having an increased size, so that it is difficult to make the members or parts compact and light.

Further, the ferritic Fe—Ni—Cr—Al alloy of JP-A-9-263906 is a material which is improved in properties of oxidation resistance, corrosion resistance to molten metal, wear resistance and so on by forming a film primarily comprising aluminum oxides on the surface of the alloy by heating the alloy in an oxidizing atmosphere at a temperature in the range of 800 to 1300° C. As will be understood from embodiments of JP'906, the inner metal structure of the alloy has a very high Vickers hardness of not less than 413 HV.

However, since the alloy of JP'906 is directed to a tool material on which the film is formed primarily comprising aluminum oxides to improve properties of oxidation resistance, corrosion resistance to molten metal, wear resistance and so on, any particular attentions are not paid to tensile properties including 0.2% yield strength and elongation determined by a tensile test, such properties being required for structural members and parts.

An object of the present invention is to provide an Fe—Cr—Ni—Al alloy which can possess both of excellent oxidation resistance and good mechanical properties especially at room temperature and which can be applied to structural members and parts, and to provide an alloy plate made of the same alloy and a material for a substrate made of the same alloy.

With regard to the ferritic Fe—Cr—Ni—Al alloy, the present inventors made every effort to realize a balance among chemical components according to which the tensile strength is adjustable at a proper level while keeping good oxidation resistance. As a result, it has been found that, when the amounts of Ni, Cr and Al in the Fe—Ni—Cr—Al alloy are adjusted in proper ranges, it is possible to keep the matrix to have a single phase structure of ferrite, and to finely precipitate an intermetallic compound of Ni—Al, which greatly contributes to precipitation strengthening of the alloy, in the ferrite matrix, whereby a high strength can be realized without deterioration of good oxidation resistance, cold workability and ductility.

It has been also found that, when the alloy contains small amounts of C and Zr, carbides are formed to keep ferrite crystal grains of the Fe—Ni—Cr—Al fine, thereby enabling to improve the alloy in 0.2% yield strength while keeping ductility and toughness at proper levels.

Further, it has been found that, when optionally one or more elements selected from the group of Hf, V, Nb, Ta, Y and REM (rare earth metals) are added, an adhesiveness of an oxide film to the alloy base is improved, the oxide film being primarily composed of aluminum oxides and formed on the surface of the alloy when exposed to a high temperature.

Moreover, it has been found that it is necessary to adjust a Cr equivalent, which has been defined by an F value determined on the basis of a result of experimental investigation by the present inventors, to a specific value as well as adjustment of the amount of the respective alloying elements, and that it is necessary to adjust the amount of solute elements defined by an S value to a specific value in order to obtain good cold workability of the alloy, resulting in the present invention.

Thus, according to a first aspect of the invention, there is provided a ferritic Fe—Cr—Ni—Al alloy having excellent oxidation resistance and high strength, which consists essentially of, by mass, 0.003 to 0.08% C, 0.03 to 2.0% Si, not more than 2.0% Mn, from more than 1.0% to not more than 8.0% Ni, from not less than 10.0% to less than 19.0% Cr, 1.5 to 8.0% Al, 0.05 to 1.0% Zr, and the balance of Fe and incidental impurities, wherein an F value is not less than 12% and an S value is not more than 25%, where the F value is defined by the following equation (1) and the S value is defined by the following equation (2):

$$F=-34.3C+0.48Si-0.012Mn-1.4Ni+Cr+2.48Al, \quad (1)$$

and $$S=Ni+Cr+Al, \quad (2)$$

and wherein the Fe—Cr—Ni—Al alloy, after an annealing heat treatment at 600 to 1050° C., has 0.2% yield strength of 550 to 1,000 MPa by a tensile test at room temperature.

According to a second aspect of the invention, there is provided a ferritic Fe—Cr—Ni—Al alloy having excellent oxidation resistance and high strength, which consists essentially of, by mass, 0.003 to 0.06% C, 0.03 to 1.0% Si, not more than 2.0% Mn, from more than 1.0% to less than 5.0% Ni, 10.0 to 17.0% Cr, from not less than 1.5% to less than 4.0% Al, 0.05 to 0.8% Zr, and the balance of Fe and incidental impurities, wherein the F value is not less than 12% and the S value is not more than 25%, and wherein the Fe—Cr—Ni—Al alloy, after an annealing heat treatment at 600 to 1050° C., has 0.2% yield strength of 550 to 1,000 MPa by a tensile test at room temperature.

In the above ferritic Fe—Cr—Ni—Al alloys having excellent oxidation resistance and high strength, preferably 0.05 to 1.0% in total of one or more elements selected from the group of Hf, V, Nb and Ta are added. It is also preferred to add 0.05 to 1.0% in total of one or more elements selected from the group of Hf, V, Nb and Ta, and/or 0.05 to 1.0% in total of at least one element selected from Y and REM to the ferritic Fe—Cr—Ni—Al alloys.

Preferably, the Fe—Cr—Ni—Al alloy, after an annealing heat treatment at 600 to 1050° C. of temperature, has a Vickers hardness of 250 to 410 HV.

Preferably, the Fe—Cr—Ni—Al alloy has a mean coefficient of thermal expansion $11\times10^{-6}$ to $14\times10^{-6}$/° C. in a temperature range of 20 to 800° C.

The invention alloy is excellent in cold workability, so that a ferritic alloy plate and a plate for substrates can be produced.

It should be also noted that such a plate can be produced by the powder metallurgical method from a powder of the invention alloy.

DETAILED DESCRIPTION OF THE INVENTION

Herein below, there will be described functions of the alloying elements in the invention alloy.

C (carbon) forms carbides with Cr and Zr in the invention alloy to deteriorate effects of the additive alloying elements. Thus, the carbon amount is preferably low. Further, a much amount of carbon makes the ferrite phase unstable, since carbon is an austenite forming element. On the other hand, in the case where the carbon amount is small, ferrite grains of the alloy can be maintained fine since carbides restrain grain boundaries of the ferrite not to move while maintaining the ferrite structure. If the carbon amount is less than 0.003%, the refining effect by carbides cannot be obtained. If the carbon amount is more than 0.08%, coarse carbides increase to deteriorate ductility and workability of the alloy. Thus, the carbon amount is set to 0.003 to 0.08%, preferably from 0.003 to 0.06%.

Si is added in a small amount as a deoxidizer, and it has an effect of improving oxidation resistance. However, if the Si amount is less than 0.03%, the above effect cannot be enough obtained. On the other hand, even if the Si amount is more than 2.0%, any further marked improvement in the above effect can not be obtained. Thus, the Si amount is set to 0.03 to 2.0%, preferably from 0.03 to 1.0%.

Mn, which acts as a deoxidizing and desulfurizing agent, is added to improve the alloy in cleanliness. An excess amount of more than 2.0% Mn deteriorates hot workability of the alloy. The Mn amount is preferably not more than 2.0%, more preferably not more than 1.0%.

Ni is an indispensable alloying element to the invention alloy. It dissolves in the ferrite matrix to strengthen the same, while a part of Ni forms an intermetallic compound of Ni—Al together with Al to finely precipitate and disperse in the ferrite matrix whereby strengthening the matrix. If the Ni amount is not more than 1.0%, the above mentioned strengthening effects is insufficient. On the other hand, if the Ni amount is more than 8.0%, the alloy strength become too high resulting in deteriorated ductility of the alloy, and occasionally an austenite phase is formed at a high temperature to make the ferrite phase unstable. Thus, the Ni amount is set to a range of from more than 1.0% to not more than 8.0%, preferably from more than 1.0% to less than 5.0%.

Cr is a ferrite forming element, and indispensable for making the matrix of the Fe—Ni—Cr—Al alloy to be the ferrite structure. It is also important in order to obtain good oxidation resistance because it forms a uniform and fine oxide film on the alloy surface, the oxide film being primarily composed of aluminum oxides at a high temperature and having a good adhesiveness to the alloy surface. If the Cr amount is less than 10.0%, the enough effect cannot be obtained. On the other hand, if the Cr amount is not less than 19.0%, the alloy is deteriorated in cold and hot workability. Thus, the Cr amount is set to a range from not less than 10.0% to less than 19.0%, preferably 10.0% to 17.0%, more preferably 13.0 to 17.0%.

Al combines with Ni to form an intermetallic compound of Ni—Al which finely precipitates in the ferrite matrix to strengthen it. It is also important in order to obtain good oxidation resistance because it forms a uniform and fine oxide film on the alloy surface, the oxide film being primarily composed of aluminum oxides at a high temperature and having a good adhesiveness to the alloy surface. If the Al amount is less than 1.5%, the enough effect cannot be obtained. On the other hand, if the Al amount exceeds 8.0%, not only the alloy is deteriorated in cold and hot workability, but also it may have too high strength whereby it is deteriorated in ductility. Thus, the Al amount is set to 1.5 to 8.0%, preferably from not less than 1.5% to less than 4.0%.

Zr is indispensable because of an important effect of forming oxide particles in a ferrite phase closely under the film, which is primarily composed of aluminum oxides and formed on the alloy surface at a high temperature, to remarkably improve the adhesion property of the film being primarily composed of aluminum oxides, and because of forming carbides to refine ferrite grains thereby improving tensile properties. However, if the Zr amount is less than 0.05%, the above effects are not enough. On the other hand, if the Zr amount exceeds 1.0%, the oxide particles become coarse to inversely deteriorate the adhesion property of the film, and a part of Zr combines with carbon to form coarse carbides resulting in deteriorated cold workability and ductility. Thus, the Zr amount is set to 0.05 to 1.0%, preferably from 0.05% to 0.8%.

Hf, V, Nb and Ta are optional elements. They form carbides to refine the ferrite grains thereby improving tensile properties, and improve the adhesion property of the oxide film being primarily composed of Al. However, if those amount is less than 0.05%, the above effects are not enough. On the other hand, if those amount exceeds 1.0%, carbides become coarse thereby deteriorating the ductility. Thus, one or more of Hf, V, Nb and Ta is added in the alloy in a total amount of 0.05 to 1.0%.

Y and REM are optional elements and one or both thereof are added in the alloy. They form oxide particles in the ferrite phase closely under the film, which is primarily composed of aluminum oxides and formed on the alloy surface at a high temperature, to remarkably improve the adhesion property of the film being primarily composed of aluminum oxides. However, if those amount is less than 0.05%, the above effect is not enough. On the other hand, if those amount exceed 1.0%, oxide particles become coarse to inversely deteriorate the adhesion property of the film. Thus, one or both of Y and REM is added in the alloy in a total amount of 0.05 to 1.0%.

In order to make the matrix structure of the invention alloy to be a single phase of ferrite, it is necessary to not only adjust the components of the alloy within the specified amount ranges, respectively, but also optimize the balance among the components.

Here, the F value as defined by equation (1) is a Cr equivalent which indicates a stability of the ferrite phase of the invention alloy. The Cr equivalent defined by equation (1) is obtained by adding together values obtained by multiplying a mass % of each of Cr, Si and Al, which are the ferrite forming elements, by a coefficient of the each ferrite forming element representing a formation easiness of the ferrite phase, and by subtracting values obtained by multiplying a mass % of each of Ni, C and Mn, which are the austenite forming elements, by a coefficient of the each austenite forming element representing a formation easiness of the austenite phase from the former values. If the F value is lower than 12%, the matrix structure can not be a single phase of ferrite, and a martensite structure and/or an austenite phase coexist, so that any stable properties of the alloy can not be obtained. Thus, the F value is set to not less than 12%.

The S value as defined by equation (2) represents, the total amounts of, by mass %, Ni, Cr and Al which are the primary alloying elements of the invention alloy. In order to improve the cold and hot workability of the alloy and ensure good tensile ductility of the alloy, it is necessary to adjust amounts of the additive alloying elements to be low levels without deterioration of alloy properties. If the S value exceeds 25%, cracks are liable to occur during cold and hot working processes resulting in deterioration of a yield during working. Thus, the S value is set to not more than 25%, preferably not more than 23%.

Further, the invention alloy comprises a main component of Fe and incidental impurities. In the case where the invention alloy is required to have not only oxidation resistance at a high temperature but also a high temperature strength, the alloy may comprise one or more of Mo, W and Co in a total amount of not more than 2.0%.

In order to strengthen grain boundaries and form sulfides to fix sulfur for the purpose of improving hot workability, the alloy may comprise one or more of B, Mg and Ca in a total amount of not more than 0.05%.

With regard to impurity elements of P, S, N and O, although their contents are preferably as low as possible, because, in order to extremely reduce those amounts, strictly selected expensive raw materials are used, and refining melting causes a much cost, so long as the following amount ranges are satisfied, the alloy may contain those impurity elements: $P \leqq 0.04\%$, $S \leqq 0.01\%$, $N \leqq 0.04\%$ and $O \leqq 0.01\%$, according to which no problems will arise in the material properties and the productivity.

After plastic working, which is hot or cold working, the invention alloy is preferably annealed at a proper temperature in a range of 600 to 1050° C. in order to remove non-uniform strain which occurs during plastic working thereby increasing the ductility of the alloy, and to make ferrite grains uniform and fine. If the annealing temperature is lower than 600° C., a longer time is needed for removal of the strain. On the other hand, if the annealing temperature is higher than 1050° C., the strain can be removed in a short time while crystalline grains become coarse to deteriorate toughness of the alloy. Thus, the annealing temperature is set in a range of from 600 to 1050° C. It should be noted that the annealing time is preferably adjusted so as to be longer at a low temperature and shorter at a high temperature.

For example, when the annealing treatment is carried out at 700° C., the alloy is preferably kept for 4 hours, and when it is carried out at 950° C., keeping about 3 minutes is enough. The proper annealing treatment permits regulating the 0.2% yield strength of the invention alloy to a range in which the alloy can be used for structural members and structural parts. If the 0.2% yield strength is less than 550 MPa, the strength is insufficient to use the alloy for the structural members and structural parts in which the high strength is required, and on the other hand, if it is more than 1000 MPa, the ductility and toughness deteriorate. In consequence, the 0.2% yield strength is set in a range from 550 to 1000 MPa.

Hardness is a property necessary to use the alloy for the structural members and structural parts similarly to the 0.2% yield strength. If the hardness is less than 250 HV, the hardness is insufficient to use the alloy for the structural members and structural parts in which the high strength is required, and on the other hand, if it is higher than 410 HV, the number of steps of cold working and machining increases, and there is a concern for deterioration of ductility and toughness of the alloy. In consequence, the hardness is set in a range from 250 to 410 HV.

A thermal expansion coefficient of the alloy is suitably close to that of a different material such as a carbon steel, an alloy steel, a ceramic material, a glass or a resin to be joined thereto, in the case that the alloy is used for the structural members or structural parts, particularly for an alloy plate for a substrate. However, in the alloy of the present invention, the suitable thermal expansion coefficient can be attained by bringing the matrix structure into the ferrite single phase. The thermal expansion coefficient is often usually represented by an average at temperatures of from room temperature to higher temperatures, and here, it is represented by a mean coefficient of thermal expansion from 20 to 800° C. When the matrix structure of the invention alloy is brought into the single phase of ferrite, the thermal expansion coefficient is in a range of $11\times10^{-6}$ to $14\times10^{-6}$/° C.

Furthermore, the alloy of the present invention can relatively easily be plastic-worked into a plate by hot or cold working. In addition, when oxidized at a high temperature, the oxide film having good adhesive properties mainly comprising the oxide of aluminum can be formed on the surface of an alloy plate. Therefore, the above-mentioned plate can suitably be worked to obtain an alloy plate for a substrate, whereby there can be impart, to the plate, a feature that the alloy plate is scarcely delaminated from the different material even when it is bonded thereto.

EXAMPLE

Each of invention alloys and comparative alloys was molten in a vacuum induction melting furnace to prepare 10 kg of an ingot, followed by hot forging. During this hot forging, any cracks did not occur in any alloy, and the hot working was good. Furthermore, hot rolling was carried out to obtain an alloy plate of about 2 mm thick, and an annealing treatment was then done at 680° C. After the removal of an oxide scale from the surface of the alloy plate, cold rolling was carried out to prepare an alloy plate having a thickness of about 1 mm. Afterward, an annealing treatment was done by keeping a suitable temperature in a range of from 850° C. to 950° C. for 3 minutes, followed by rapid cooling.

Table 1 shows chemical compositions of alloy Nos. 1 to 12 of the present invention and comparative alloy Nos. 21 to 27.

Furthermore, Table 2 shows cold workability of the respective alloys when they were subjected to cold rolling, matrix structures after the annealing treatment, values of 0.2% yield strength, Vickers hardness and mean coefficient of thermal expansion from 20 to 800° C., and oxidation resistance in the case that heating was kept at 900° C. for 10 minutes. Here, the cold workability was judged by a state of occurred cracks during the cold working. The letter A represents a state where any cracks did not occur and the working was easily possible, B represents a state where any cracks did not occur but resistance to deformation was slightly large, and C represents a state where some cracks occurred. Moreover, the oxidation resistance was judged by the adhesive properties of an oxide scale after the keeping of heating and subsequent air cooling. The letter B represents a state where the adhesive properties of the oxide scale were good, and C represents a state where the oxide scale was delaminated.

TABLE 1

(mass %)

| No. | C | Si | Mn | Ni | Cr | Al | Zr | Fe | Others | F value | S value | Remarks |
|---|---|---|---|---|---|---|---|---|---|---|---|---|
| 1 | 0.047 | 0.30 | 0.49 | 3.95 | 17.94 | 2.96 | 0.20 | Bal. | | 18.28 | 24.85 | Invention alloy |
| 2 | 0.049 | 0.29 | 0.49 | 3.92 | 11.97 | 2.97 | 0.20 | Bal. | | 12.30 | 18.86 | Invention alloy |
| 3 | 0.047 | 0.29 | 0.49 | 3.92 | 14.98 | 2.95 | 0.20 | Bal. | | 15.33 | 21.85 | Invention alloy |
| 4 | 0.047 | 0.29 | 0.55 | 2.82 | 14.99 | 2.94 | 0.19 | Bal. | | 16.85 | 20.75 | Invention alloy |
| 5 | 0.046 | 0.31 | 0.53 | 2.57 | 14.97 | 2.93 | 0.19 | Bal. | | 17.20 | 20.47 | Invention alloy |
| 6 | 0.009 | 0.23 | 0.54 | 3.14 | 12.05 | 2.92 | 0.17 | Bal. | | 14.69 | 18.11 | Invention alloy |
| 7 | 0.014 | 0.42 | 0.63 | 3.16 | 14.88 | 3.07 | 0.05 | Bal. | Nb = 0.07 | 17.78 | 21.11 | Invention alloy |
| 8 | 0.035 | 0.34 | 0.47 | 2.93 | 14.97 | 2.98 | 0.11 | Bal. | V = 0.12 | 17.22 | 20.88 | Invention alloy |
| 9 | 0.034 | 0.24 | 0.54 | 3.17 | 15.16 | 3.04 | 0.12 | Bal. | Hf = 0.11, Y = 0.08 | 17.20 | 21.37 | Invention alloy |
| 10 | 0.041 | 0.16 | 0.48 | 3.18 | 15.35 | 3.13 | 0.14 | Bal. | Ta = 0.07, REM = 0.06 | 17.33 | 21.66 | Invention alloy |
| 11 | 0.023 | 0.29 | 0.55 | 3.06 | 14.84 | 2.86 | 0.21 | Bal. | Y = 0.07 | 16.99 | 20.76 | Invention alloy |
| 12 | 0.032 | 0.35 | 0.48 | 3.05 | 15.36 | 2.97 | 0.22 | Bal. | REM = 0.06 | 17.52 | 21.38 | Invention alloy |
| 21 | 0.004 | 0.14 | 0.49 | 10.32 | 18.57 | 5.10 | 0.17 | Bal. | | 16.69 | 33.99 | Comparative alloy |
| 22 | 0.005 | 0.27 | 0.56 | 16.18 | 17.94 | 4.90 | 0.21 | Bal. | | 7.39 | 39.02 | Comparative alloy |
| 23 | 0.023 | 0.11 | 0.61 | 4.07 | 18.26 | 5.12 | 0.23 | Bal. | | 24.52 | 27.45 | Comparative alloy |
| 24 | 0.017 | 0.33 | 0.54 | 10.19 | 18.17 | 2.92 | 0.14 | Bal. | | 10.71 | 31.28 | Comparative alloy |
| 25 | 0.011 | 0.24 | 0.52 | 3.98 | 11.85 | 1.39 | 0.20 | Bal. | | 9.46 | 17.22 | Comparative alloy |
| 26 | 0.008 | 0.26 | 0.53 | 1.04 | 12.09 | 0.48 | 0.19 | Bal. | | 11.67 | 13.61 | Comparative alloy |
| 27 | 0.041 | 0.28 | 0.51 | 0.11 | 15.00 | 2.95 | — | Bal. | Ti = 0.28 | 20.88 | 18.06 | Comparative alloy |

*Note: Bal. = balance

TABLE 2

| No. | Cold Workability | Annealing Temp. (° C.) | Matrix Structure | 0.2% Yield Strength (MPa) | Vickers Hardness | Mean Thermal Expansion Coefficient ($\times 10^{-6}$/° C.) | Oxidation Resistance | Remarks |
|---|---|---|---|---|---|---|---|---|
| 1 | B | 850 | α | 941 | 401 | 13.6 | B | Invention Alloy |
| 2 | B | 950 | α | 902 | 394 | 13.5 | B | Invention Alloy |
| 3 | B | 950 | α | 982 | 383 | 13.3 | B | Invention Alloy |
| 4 | A | 950 | α | 765 | 359 | 13.3 | B | Invention Alloy |
| 5 | A | 950 | α | 624 | 285 | 13.1 | B | Invention Alloy |
| 6 | A | 950 | α | 579 | 258 | 13.0 | B | Invention Alloy |
| 7 | A | 950 | α | 815 | 367 | 13.3 | B | Invention Alloy |
| 8 | A | 900 | α | 766 | 349 | 13.2 | B | Invention Alloy |

TABLE 2-continued

| No. | Cold Workability | Annealing Temp. (° C.) | Matrix Structure | 0.2% Yield Strength (MPa) | Vickers Hardness | Mean Thermal Expansion Coefficient ($\times 10^{-6}$/° C.) | Oxidation Resistance | Remarks |
|---|---|---|---|---|---|---|---|---|
| 9 | B | 950 | α | 794 | 358 | 13.3 | B | Invention Alloy |
| 10 | B | 850 | α | 829 | 370 | 13.2 | B | Invention Alloy |
| 11 | B | 900 | α | 761 | 339 | 13.2 | B | Invention Alloy |
| 12 | B | 950 | α | 773 | 357 | 13.3 | B | Invention Alloy |
| 21 | C | 950 | α | 1042 | 443 | 13.6 | B | Comparative Alloy |
| 22 | C | 950 | α + γ | 916 | 392 | 14.2 | B | Comparative Alloy |
| 23 | C | 950 | α | 947 | 404 | 13.5 | B | Comparative Alloy |
| 24 | C | 950 | α + γ | 644 | 287 | 14.1 | B | Comparative Alloy |
| 25 | A | 950 | α + α' | 468 | 211 | 13.1 | C | Comparative Alloy |
| 26 | A | 950 | α + α' | 310 | 135 | 13.0 | C | Comparative Alloy |
| 27 | A | 850 | α | 323 | 174 | 13.0 | B | Comparative Alloy |

Table 2 indicates that the alloy Nos. 1 to 12 of the present invention are all excellent in the cold workability, and the matrix structure after the annealing treatment is a ferrite (α) single phase. In addition, with regard to the alloy Nos. 1 to 12 of the present invention, values of the 0.2% yield strength are in a range from 550 to 1000 MPa, and values of the Vickers hardness are in a range from 250 to 410 HV. Furthermore, values of the thermal expansion coefficient of the alloys according to the present invention are in a range from $11\times10^{-6}$ to $14\times10^{-6}$/° C., and the oxidation resistance is also excellent.

On the other hand, the comparative alloy Nos. 21 to 24 having S values of more than 25 are slightly poor in the cold workability. Furthermore, of the comparative alloys having F values of less than 12, each of Nos. 22 and 24 contains a ferrite (α) phase and an austenite (γ) phase together, and each of Nos. 25 and 26 contains a martensite (α') phase in addition to a ferrite (α) phase. In these alloys, any ferrite single phase structure is not obtained. Moreover, in the comparative alloy No. 21 containing a large amount of Ni and having the ferrite single phase structure, the 0.2% yield strength and the hardness are too high. Each of the comparative alloy Nos. 22 and 24 containing much Ni and the austenite phase has the large thermal expansion coefficient. Inversely, in the comparative alloy Nos. 25, 26 and 27 containing a less amount of Ni or Al which has an effect of the precipitation strengthening, the 0.2% yield strength and the hardness are low. In addition, in the comparative alloy Nos. 25 and 26 containing a less amount of Al, the oxidation resistance is slightly poor.

As described above, a ferritic Fe—Ni—Cr—Al alloy of the present invention easily permits hot working and cold working, and possesses both of high strength and good oxidation resistance. When used for structural members and structural parts which are used in the atmospheric environment ranging from room temperature or so to a high temperature, this type of alloy contributes to the miniaturization and lightening of the parts, and has good durability. Accordingly, the alloy of the present invention is expected to have industrially remarkable effects.

What is claimed is:

1. A ferritic Fe—Cr—Ni—Al alloy having excellent oxidation resistance and high strength, which consists essentially of, by mass, 0.003 to 0.08% C, 0.03 to 2.0% Si, not more than 2.0% Mn, from not less than 2.57% to not more than 8.0% Ni, from not less than 10.0% to less than 19.0% Cr, 1.5 to 8.0% Al, 0.05 to 1.0% Zr, and the balance of Fe and incidental impurities, wherein an F value is not less than 12% and an S value is not more than 25%, where the F value is defined by the following equation (1) and the S value is defined by the following equation (2):

$$F=-34.3C+0.48Si-0.012Mn-1.4Ni+Cr+2.48Al, \quad (1)$$

and $$S=Ni+Cr+Al, \quad (2)$$

and wherein the Fe—Cr—Ni—Al alloy has, as a result of an annealing heat treatment at 600 to 1050° C., a metal structure in which precipitates of a Ni—Al intermetallic compound are dispersed and a 0.2% yield strength of 550 to 1,000 MPa by a tensile test at room temperature.

2. A ferritic Fe—Cr—Ni—Al alloy having excellent oxidation resistance and high strength, which consists essentially of, by mass, 0.003 to 0.06% C, 0.03 to 1.0% Si, not more than 2.0% Mn, from not less than 2.57% to less than 5.0% Ni, 10.0 to 17.0% Cr, from not less than 1.5 to less than 4.0% Al, 0.05 to 0.8% Zr, and the balance of Fe and incidental impurities, wherein an F value is not less than 12% and an S value is not more than 25%, where the F value is defined by the following equation (1) and the S value is defined by the following equation (2):

$$F=-34.3C+0.48Si-0.012Mn-1.4Ni+Cr+2.48Al, \quad (1)$$

and $$S=Ni+Cr+Al, \quad (2)$$

and wherein the Fe—Cr—Ni—Al alloy has, as a result of an annealing heat treatment at 600 to 1050° C., a Vickers hardness of 250 to 410 HV, a mean coefficient of thermal expansion of $11\times10^{-6}$ to $14\times10^{-6}$/° C. from 20 to 800°°C., and a metal structure in which precipitates of a Ni—Al intermetallic compound are dispersed and a 0.2% yield strength of 550 to 1,000 MPa by a tensile test at room temperature.

3. A ferritic Fe—Cr—Ni—Al alloy having excellent oxidation resistance and high strength, which consists essentially of, by mass, 0.003 to 0.08% C, 0.03 to 2.0% Si, not more than 2.0% Mn, from not less than 2.57% to not more than 8.0% Ni, from not less than 10.0 to less than 19.0% Cr, 1.5 to 8.0% Al, 0.05 to 1.0% Zr, 0.05 to 1.0% in total of one or more elements selected from the group consisting of Hf, V, Nb and Ta, and the balance of Fe and incidental impurities, wherein an F value is not less than 12% and an S value is not more than 25%, where the F value is defined by the following equation (1) and the S value is defined by the following equation (2):

$$F=-34.3C+0.48Si-0.012Mn—1.4Ni+Cr+2.48Al, \quad (1)$$

and $$S=Ni+Cr+Al, \quad (2)$$

and wherein the Fe—Cr—Ni—Al alloy has, as a result of an annealing heat treatment at 600 to 1050° C., a Vickers hardness of 250 to 410 NV, a mean coefficient of thermal expansion of $11\times10^{-6}$ to $14\times10^{-6}$/° C. from 20 to 800° C., and a metal structure in which precipitates of a Ni—Al intermetallic compound are dispersed and a 0.2% yield strength of 550 to 1,000 MPa by a tensile test at room temperature.

4. A ferritic Fe—Cr—Ni—Al alloy having excellent oxidation resistance and high strength, which consists essentially of, by mass, 0.003 to 0.06% C, 0.03 to 1.0% Si, not more than 2.0% Mn, from not less than 2.57% to less than 5.0% Ni, 10.0 to 17.0% Cr, from 1.5% to less than 4.0% Al, 0.05 to 0.8% Zr, 0.05 to 1.0% in total of one or more elements selected from the group consisting of Hf, V, Nb and Ta, and the balance of Fe and incidental impurities, wherein an F value is not less than 12% and an S value is not more than 25%, where the F value is defined by the following equation (1) and the S value is defined by the following equation (2):

$$F=-34.3C+0.48Si-0.012Mn—1.4Ni+Cr+2.48Al, \quad (1)$$

and $$S=Ni+Cr+Al, \quad (2)$$

and wherein the Fe—Cr—Ni—Al has, as a result of an annealing heat treatment at 600 to 1050° C., a Vickers hardness of 250 to 410 HV, a mean coefficient of thermal expansion of $11\times10^{-6}$ to $14\times10^{-6}$/° C. from 20 to 800° C., and a metal structure in which precipitates of a Ni—Al intermetallic compound are dispersed and a 0.2% yield strength of 550 to 1,000 MPa by a tensile test at room temperature.

5. A ferritic Fe—Cr—Ni—Al alloy having excellent oxidation resistance and high strength, which consists essentially of, by mass, 0.003 to 0.08% C, 0.03 to 2.0% Si, not more than 2.0% Mn, from not less than 2.57% to not more than 8.0% Ni, from not less than 10.0% to less than 19.0% Cr, 1.5% to 8.0% Al, 0.05 to 1.0% Zr, 0.05 to 1.0% in total of at least one element selected from the group consisting of Y and REM, and the balance of Fe and incidental impurities, wherein an F value is not less than 12% and an S value is not more than 25%, where the F value is defined by the following equation (1) and the S value is defined by the following equation (2):

$$F=-34.3C+0.48Si-0.012Mn-1.4Ni+Cr+2.48Al, \quad (1)$$

and $$S=Ni+Cr+Al, \quad (2)$$

and wherein the Fe—Cr—Ni—Al alloy has, as a result of an annealing heat treatment at 600 to 1050° C., a Vickers hardness of 250 to 410 HV, a mean coefficient of thermal expansion of $11\times10^{-6}$ to $14\times10^{-6}$/° C. from 20 to 800° C., and a metal structure in which precipitates of a Ni—Al intermetallic compound are dispersed and a 0.2% yield strength of 550 to 1,000 MPa by a tensile test at room temperature.

6. A ferritic Fe—Cr—Ni—Al alloy having excellent oxidation resistance and high strength, which consists essentially of, by mass, 0.003 to 0.06% C, 0.03 to 1.0% Si, not more than 2.0% Mn, from not less than 2.57% to less than 5.0% Ni, 10.0 to 17.0% Cr, from not less than 1.5% to less than 4.0% Al, 0.05 to 0.8% Zr, 0.05 to 1.0% in total of at least one element selected from the group consisting of Y and REM, and the balance of Fe and incidental impurities, wherein an F value is not less than 12% and an S value is not more than 25%, where the F value is defined by the following equation (1) and the S value is defined by the following equation (2):

$$F=-34.3C+0.48Si-0.012Mn-1.4Ni+Cr+2.48Al, \quad (1)$$

and $$S=Ni+Cr+Al, \quad (2)$$

and wherein the Fe—Cr—Ni—Al alloy has, as a result of an annealing heat treatment at 600 to 1050° C., a Vickers hardness of 250 to 410 HV, a mean coefficient of thermal expansion of $11\times10^{6}$ to $14\times10^{-6}$/° C. from 20 to 800° C., and a metal structure in which precipitates of a Ni—Al intermetallic compound are dispersed and a 0.2% yield strength of 550 to 1,000 MPa by a tensile test at room temperature.

7. A ferritic Fe—Cr—Ni—Al alloy having excellent oxidation resistance and high strength, which consists essentially of, by mass, 0.003 to 0.08% C, 0.03 to 2.0% Si, not more than 2.0% Mn, from not less than 2.57% to not more than 8.0% Ni, from not less than 10.0% to less than 19.0% Cr, 1.5 to 8.0% Al, 0.05 to 1.0% Zr, 0.05 to 1.0% in total of one or more elements selected from the group consisting of Hf, V, Nb and Ta, 0.05 to 1.0% in total of at least one element selected from the group consisting of Y and REM, and the balance of Fe and incidental impurities, wherein an F value is not less than 12% and an S value is not more than 25%, where the F value is defined by the following equation (1) and the S value is defined by the following equation (2):

$$F=-34.3C+0.48Si-0.012Mn-1.4Ni+Cr+2.48Al, \quad (1)$$

and $$S=Ni+Cr+Al, \quad (2)$$

and wherein the Fe—Cr—Ni—Al alloy has, as a result of an annealing heat treatment at 600 to 1050° C., a Vickers hardness of 250 to 410 HV, a mean coefficient of thermal expansion of $11\times10^{-6}$ to $14\times10^{-6}$/° C. from 20 to 800° C., and a metal structure in which precipitates of a Ni—Al intermetallic compound are dispersed and a 0.2% yield strength of 550 to 1,000 MPa by a tensile test at room temperature.

8. A ferritic Fe—Cr—Ni—Al alloy having excellent oxidation resistance and high strength, which consists essentially of, by mass, 0.003 to 0.06% C, 0.03 to 1.0% Si, not more than 2.0% Mn, from not less than 2.57% to less than 5.0% Ni, 10.0 to 17.0% Cr, from not less than 1.5% to less than 4.0% Al, 0.05 to 0.08% Zr, 0.05 to 1.0% in total of one or more elements selected from the group consisting of Hf, V, Nb and Ta, 0.05 to 1.0% in total of at least one element selected from the group consisting of Y and REM, and the balance of Fe and incidental impurities, wherein an F value is not less than 12% and an S value is not more than 25%, where the F value is defined by the following equation (1) and the S value is defined by the following equation (2):

$$F=-34.3C+0.48Si-0.012Mn-1.4Ni+Cr+2.48Al, \quad (1)$$

and $$S=Ni+Cr+Al, \quad (2)$$

and wherein the Fe—Cr—Ni—Al alloy has, as a result of an annealing heat treatment at 600 to 1050° C., a Vickers hardness of 250 to 410 HV, a mean coefficient of thermal expansion of $11\times10^{-6}$ to $14\times10^{-6}$/° C. from 20 to 800° C., and a metal structure in which precipitates of a Ni—Al intermetallic compound are dispersed and a 0.2% yield strength of 550 to 1,000 MPa by a tensile test at room temperature.

9. An alloy plate made of the ferritic Fe—Cr—Ni—Al alloy as defined in claim 1.

10. An alloy plate for a substrate made of the ferritic Fe—Cr—Ni—Al alloy as defined in claim 1.

11. An alloy plate made of the ferritic Fe—Cr—Ni—Al alloy as defined in claim 2.

12. An alloy plate made of the ferritic Fe—Cr—Ni—Al alloy as defined in claim 3.

13. An alloy plate made of the ferritic Fe—Cr—Ni—Al alloy as defined in claim 4.

14. An alloy plate made of the ferritic Fe—Cr—Ni—Al alloy as defined in claim 5.

15. An alloy plate made of the ferritic Fe—Cr—Ni—Al alloy as defined in claim 6.

16. An alloy plate made of the ferritic Fe—Cr—Ni—Al alloy as defined in claim 7.

17. An alloy plate made of the ferritic Fe—Cr—Ni—Al alloy as defined in claim 8.

18. An alloy plate for a substrate made of the ferritic Fe—Cr—Ni—Al alloy as defined in claim 2.

19. An alloy plate for a substrate made of the ferritic Fe—Cr—Ni—Al alloy as defined in claim 3.

20. An alloy plate for a substrate made of the ferritic Fe—Cr—Ni—Al alloy as defined in claim 4.

21. An alloy plate for a substrate made of the ferritic Fe—Cr—Ni—Al alloy as defined in claim 5.

22. An alloy plate for a substrate made of the ferritic Fe—Cr—Ni—Al alloy as defined in claim 6.

23. An alloy plate for a substrate made of the ferritic Fe—Cr—Ni—Al alloy as defined in claim 7.

24. An alloy plate for a substrate made of the ferritic Fe—Cr—Ni—Al alloy as defined in claim 8.

25. A ferritic Fe—Cr—Ni—Al alloy having excellent oxidation resistance and high strength, which consists essentially of, by mass, 0.003 to 0.06% C, 0.03 to 1.0% Si, not more than 2.0% Mn, from not less than 2.57% to less than 5.0% Ni, 10.0 to 17.0% Cr, from not less than 1.5 to less than 4.0% Al, 0.05 to 0.8% Zr, more than zero to not more than 2.0% in total of one or more elements selected from the group consisting of Mo, W and Co; and the balance of Fe and incidental impurities, wherein an F value is not less than 12% and an S value is not more than 25%, where the F value is defined by the following equation (1) and the S value is defined by the following equation (2):

$$F=-34.3C+0.48Si-0.012Mn-1.4Ni+Cr+2.48Al, \quad (1)$$

and $$S=Ni+Cr+Al, \quad (2)$$

and wherein the Fe—Cr—Ni—Al alloy has, as a result of an annealing heat treatment at 600 to 1050° C., a Vickers hardness of 250 to 410 HV, a mean coefficient of thermal expansion of $11\times10^{-6}$ to $14\times10^{-6}$/° C. from 20 to 800° C., and a metal structure in which precipitates of a Ni—Al intermetallic compound are dispersed and a 0.2% yield strength of 550 to 1,000 MPa by a tensile test at room temperature.

26. An alloy plate made of the ferritic Fe—Cr—Ni—Al alloy as defined in claim 25.

27. The ferritic Fe—Cr—Ni—Al alloy having excellent oxidation resistance and high strength as defined in claim 25 further containing more than zero to not more than 0.05% in total of one or more elements selected from the group consisting of B, Mg and Ca; wherein the alloy may contain the impurity elements P, S, N and O in the following amounts: $P\leqq0.04\%$; $S\leqq0.01\%$; $N\leqq0.04\%$ $O\leqq0.01\%$.

28. An alloy plate made of the ferritic Fe—Cr—Ni—Al alloy as defined in claim 27.

29. A ferritic Fe—Cr—Ni—Al alloy having excellent oxidation resistance and high strength, which consists essentially of, by mass, 0.003 to 0.06% C, 0.03 to 1.0% Si, not more than 2.0% Mn, from not less than 2.57% to less than 5.0% Ni, 10.0 to 17.0% Cr, from 1.5% to less than 4.0% Al, 0.05 to 0.8% Zr, 0.05 to 1.0% in total of one or more elements selected from the group consisting of Hf, V, Nb and Ta, more than zero to not more than 2.0% in total of one or more elements selected from the group consisting of Mo, W and Co; and the balance of Fe and incidental impurities, wherein an F value is not less than 12% and an S value is not more than 25%, where the F value is defined by the following equation (1) and the S value is defined by the following equation (2):

$$F=-34.3C+0.48Si-0.012Mn-1.4Ni+Cr+2.48A1, \quad (1)$$

and $$S=Ni+Cr+Al, \quad (2)$$

and wherein the Fe—Cr—Ni—Al alloy has, as a result of an annealing heat treatment at 600 to 1050° C., a Vickers hardness of 250 to 410 HV, a mean coefficient of thermal expansion of $11\times10^{-6}$ to $14\times10^{-6}$/° C. from 20 to 800° C., and a metal structure in which precipitates of a Ni—Al intermetallic compound are dispersed and a 0.2% yield strength of 550 to 1,000 MPa by a tensile test at room temperature.

30. An alloy plate made of the ferritic Fe—Cr—Ni—Al alloy as defined in claim 29.

31. The ferritic Fe—Cr—Ni—Al alloy having excellent oxidation resistance and high strength as defined in claim 29 further containing more than zero to not more than 0.05% in total of one or more elements selected from the group consisting of B, Mg and Ca; wherein the alloy may contain the impurity elements P, S, N and O in the following amounts: P≦0.04%; S≦0.01%; N≦0.04%; O≦0.01%.

32. An alloy plate made of the ferritic Fe—Cr—Ni—Al alloy as defined in claim 31.

33. A ferritic Fe—Cr—Ni—Al alloy having excellent oxidation resistance and high strength, which consists essentially of, by mass, 0.003 to 0.06% C, 0.03 to 1.0% Si, not more than 2.0% Mn, from not less than 2.57% to less than 5.0% Ni, 10.0 to 17.0% Cr, from not less than 1.5% to less than 4.0% Al, 0.05 to 0.8% Zr, 0.05 to 1.0% in total of at least one element selected from the group consisting of Y and REM, more than zero to not more than 2.0% in total of one or more elements selected from the group consisting of Mo, W and Co; and the balance of Fe and incidental impurities, wherein an F value is not less than 12% and an S value is not more than 25%, where the F value is defined by the following equation (1) and the S value is defined by the following equation (2):

$$F=-34.3C+0.48Si-0.012Mn-1.4Ni+Cr+2.48A1, \quad (1)$$

and $$S=Ni+Cr+Al, \quad (2)$$

and wherein the Fe—Cr—Ni—Al alloy has, as a result of an annealing heat treatment at 600 to 1050° C., a Vickers hardness of 250 to 410 HV, a mean coefficient of thermal expansion of $11\times10^{-6}$ to $14\times10^{-6}$/° C. from 20 to 800° C., and a metal structure in which precipitates of a Ni—Al intermetallic compound are dispersed and a 0.2% yield strength of 550 to 1,000 MPa by a tensile test at room temperature.

34. An alloy plate made of the ferritic Fe—Cr—Ni—Al alloy as defined in claim 33.

35. The ferritic Fe—Cr—Ni—Al alloy having excellent oxidation resistance and high strength as defined in claim 33 further containing more than zero to not more than 0.05% in total of one or more elements selected from the group consisting of B, Mg and Ca; wherein the alloy may contain the impurity elements P, S, N and O in the following amounts: P≦0.04%; S≦0.01%; N≦0.04%; O≦0.01%.

36. An alloy plate made of the ferritic Fe—Cr—Ni—Al alloy as defined in claim 35.

37. A ferritic Fe—Cr—Ni—Al alloy having excellent oxidation resistance and high strength, which consists essentially of, by mass, 0.003 to 0.06% C, 0.03 to 1.0% Si, not more than 2.0% Mn, from not less than 2.57% to less than 5.0% Ni, 10.0 to 17.0% Cr, from not less than 1.5% to less than 4.0% Al, 0.05 to 0.08% Zr, 0.05 to 1.0% in total of one or more elements selected from the group consisting of Hf, V, Nb and Ta, 0.05 to 1.0% in total of at least one element selected from the group consisting of Y and REM, more than zero to not more than 2.0% in total of one or more elements selected from the group consisting of Mo, W and Co; and the balance of Fe and incidental impurities, wherein an F value is not less than 12% and an S value is not more than 25%, where the F value is defined by the following equation (1) and the S value is defined by the following equation (2):

$$F=-34.3C+0.48Si-0.012Mn-1.4Ni+Cr+2.48A1, \quad (1)$$

and $$S=Ni+Cr+Al, \quad (2)$$

and wherein the Fe—Cr—Ni—Al alloy has, as a result of an annealing heat treatment at 600 to 1050° C., a Vickers hardness of 250 to 410 HV, a mean coefficient of thermal expansion of $11\times10^{-6}$ to $14\times10^{-6}$/° C. from 20 to 800° C., and a metal structure in which precipitates of a Ni—Al intermetallic compound are dispersed and a 0.2% yield strength of 550 to 1,000 MPa by a tensile test at room temperature.

38. An alloy plate made of the ferritic Fe—Cr—Ni—Al alloy as defined in claim 37.

39. The ferritic Fe—Cr—Ni—Al alloy having excellent oxidation resistance and high strength as defined in claim 37 further containing more than zero to not more than 0.05% in total of one or more elements selected from the group consisting of B, Mg and Ca; wherein the alloy may contain the impurity elements P, S, N and O in the following amounts: P≦0.04%; S≦0.01%; N≦0.04% O≦0.01%.

40. An alloy plate made of the ferritic Fe—Cr—Ni—Al alloy as defined in claim 39.

* * * * *